US009879415B2

(12) United States Patent
Hooker et al.

(10) Patent No.: US 9,879,415 B2
(45) Date of Patent: Jan. 30, 2018

(54) RESILIENT BEARING

(71) Applicant: ISO Systems Limited, Waikanae (NZ)

(72) Inventors: Glen Hooker, Waikanae (NZ); John Tocker, Waikanae (NZ)

(73) Assignee: ISO SYSTEMS LIMITED, Waikanae (NZ)

( * ) Notice: Subject to any disclaimer, the term of this patent is extended or adjusted under 35 U.S.C. 154(b) by 0 days.

(21) Appl. No.: 15/035,164

(22) PCT Filed: Nov. 7, 2014

(86) PCT No.: PCT/NZ2014/000227

§ 371 (c)(1),
(2) Date: May 6, 2016

(87) PCT Pub. No.: WO2015/069120

PCT Pub. Date: May 14, 2015

(65) Prior Publication Data

US 2016/0289951 A1 Oct. 6, 2016

(30) Foreign Application Priority Data

Nov. 8, 2013 (NZ) ..... 617537

(51) Int. Cl.

| | |
|---|---|
| ***E04B 1/98*** | (2006.01) |
| ***E04B 1/36*** | (2006.01) |
| ***E04H 9/02*** | (2006.01) |

(52) U.S. Cl.

CPC ..... *E04B 1/36* (2013.01); *E04B 1/98* (2013.01); *E04H 9/021* (2013.01)

(58) Field of Classification Search

CPC ..... E04B 1/36; E04B 1/98; E04H 9/021

See application file for complete search history.

(56) References Cited

U.S. PATENT DOCUMENTS 4,269,400 A * 5/1981 Jensen ..... F16F 1/025 188/268

4,599,834 A 7/1986 Fujimoto et al.

(Continued)

FOREIGN PATENT DOCUMENTS

| | | |
|---|---|---|
| FR | 2455697 | 11/1980 |
| JP | 60/250143 | 12/1985 |

(Continued)

OTHER PUBLICATIONS

International Search Report in PCT Application No. PCT/NZ2014/000227 dated Apr. 1, 2015. 3 pages.

*Primary Examiner* — Patrick J Maestri

(74) *Attorney, Agent, or Firm* — Thomas Coester Intellectual Property

(57) ABSTRACT

A resilient bearing to be positioned between a first structure and a second structure including a central connection point for connecting the resilient bearing to the first structure and a plurality of limbs extending outwardly from the central connection point to distal connection points.

The resilient bearing may be formed from a single piece of elastic material adapted to dampen forces due to environmental events. A functional property of the elastic material may vary along at least some of the plurality of limbs. The angle between each of at least some of the plurality of limbs and the second structure may be between 20 and 70 degrees.

22 Claims, 8 Drawing Sheets

(56) References Cited

U.S. PATENT DOCUMENTS

| | | | | |
|---|---|---|---|---|
| 4,901,486 | A | 2/1990 | Kobori et al. | |
| 5,131,195 | A * | 7/1992 | Bellavista | E04H 9/021 52/167.1 |
| 5,718,095 | A * | 2/1998 | Kemeny | E01F 15/0438 248/60 |
| 7,547,142 | B2 * | 6/2009 | Robinson | E01D 19/04 248/560 |

FOREIGN PATENT DOCUMENTS

| | | |
|---|---|---|
| JP | 02/232463 | 9/1990 |
| JP | 61/130640 | 6/1996 |
| JP | 08/239809 | 9/1996 |
| JP | 09/014345 | 1/1997 |
| JP | 09/268800 | 10/1997 |
| JP | 11/280295 | 10/1999 |
| JP | 2001/74094 | 3/2001 |
| JP | 2001263417 | 9/2001 |
| JP | 2001/329716 | 11/2001 |
| JP | 2003074628 | 3/2003 |
| JP | 2004 340301 | 12/2004 |
| JP | 2006/057435 | 3/2006 |
| NZ | 524611 | 3/2004 |
| NZ | 535137 | 9/2004 |
| WO | WO 2000/037823 | 6/2000 |
| WO | WO 02/084030 | 10/2002 |
| WO | WO 2004/079113 | 9/2004 |

* cited by examiner

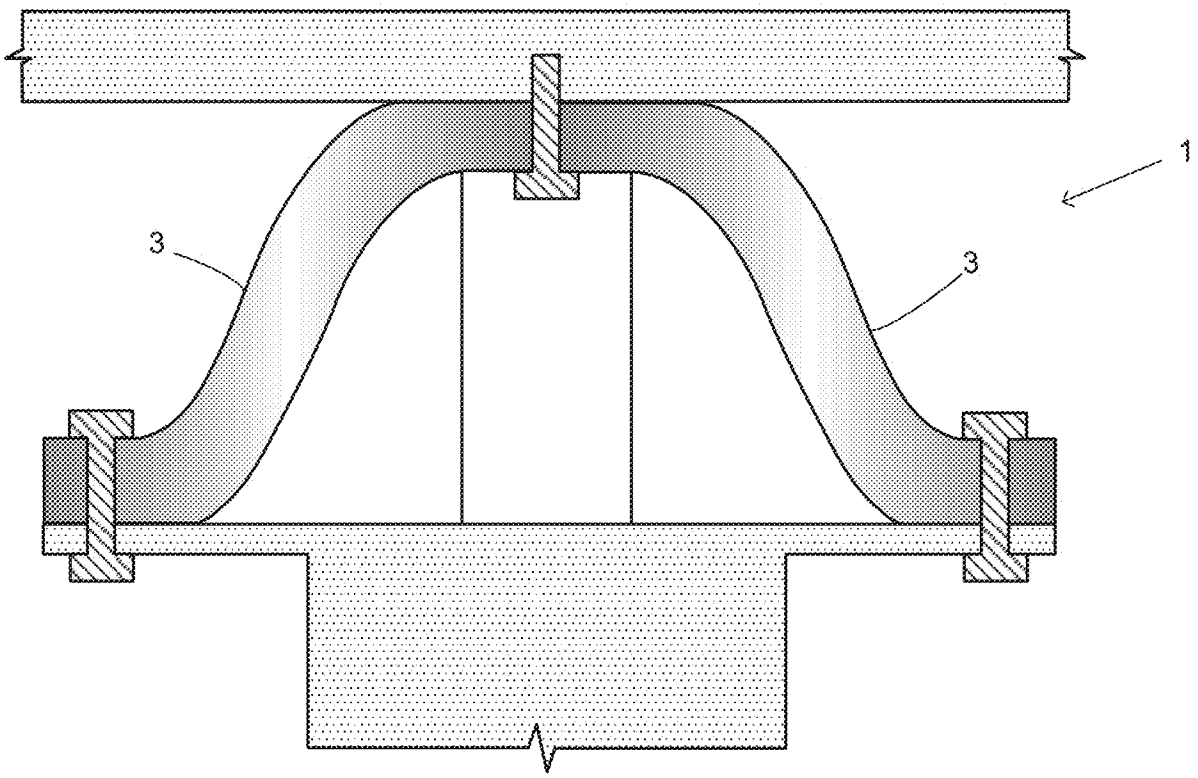
Figure 3
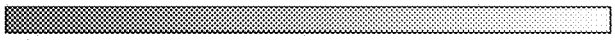
*Scale: Magnitude of functional property*

RESILIENT BEARING

FIELD OF THE INVENTION

The invention relates to resilient bearings. In particular, the invention relates to resilient bearings for use as seismic dampeners.

BACKGROUND TO THE INVENTION

The effects of earthquakes will be well known. Even when seismic activity is relatively minor, combinations of horizontal, vertical and rotational forces induce not insignificant stresses within structures connected to the ground. Such structures may include buildings, nonbuilding structures, building foundations and infrastructure (for example, road networks and power transmission networks).

If the seismic activity is more significant, so too are the induced stresses. This leads to an increased risk of damage to structures. Such damage can be costly to repair and may render a particular structure temporarily unusable. If the damage is sufficiently extensive, there is the risk of total structural failure which, in worst case scenarios, can result in the complete loss of the structure and even injury or the loss of lives.

In addition to the risks presented to the structures themselves, there are also risks to objects within or on such structures. Such objects may be damaged and present further risks of damage and injury.

As the mechanisms behind earthquakes have become better understood, there has been an improvement in the engineering of structures so as to be able to withstand earthquakes and make them safer. Those skilled in the art will appreciate that there are many aspects of earthquake engineering that improves a structure's performance under seismic activity. This includes improved and stronger building materials, improved designs, installation of tuned mass dampeners and installation of bearings.

Bearings, also known as base isolators, help minimise the effect of seismic activity by providing a connection that decouples a substructure (e.g. the ground) from the superstructure thereby reducing the forces applied to the structure. In turn this lessens the potential for damage to the structure and to objects within or on the structure. There are essentially two aspects to bearing design: isolation and dampening.

Isolation aims to minimise the transfer of forces from the substructure to the superstructure by creating a functional separation between the two structures. For example, WO2004/079113 discloses a sliding bearing with a vertical support that slides relative to an adjacent surface. The sliding bearing includes a diaphragm which acts to restore the vertical support to a central position. Though this sliding bearing can lessen the effects of horizontal and rotational forces, it would not perform well under vertical forces. Further, the design is complex and is therefore expensive.

Dampening aims to absorb the energy of forces applied to the substructure to lessen the severity of forces transferred to the superstructure. For example, lead-rubber bearings comprise a rubber column with lead inserts (such as lead plates or rods). Under seismic forces the rubber dampens forces, with the lead acting to absorb a significant amount of energy. Under light loading, the bearing will return to its normal position following the removal of the load. However, under significant loading, the lead inserts may irreversibly deform, requiring the bearing to be replaced. Lead rubber bearings are also complex to manufacture and are therefore expensive. They are also difficult and expensive to replace.

It is an object of the invention to provide a resilient bearing that alleviates at least some of the problems identified above.

It is also an object of the invention to provide a resilient bearing that is inexpensive to manufacture, performs well under all directional forces and is easy to install.

Each object is to be read disjunctively with the object of at least providing the public with a useful choice.

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of the listed components which the use directly references, and possibly also of other non-specified components or elements.

Reference to any prior art in this specification does not constitute an admission that such prior art forms part of the common general knowledge.

SUMMARY OF THE INVENTION

In a first aspect the invention provides a resilient bearing, positioned between a first structure and a second structure, including: a central connection point for connecting the resilient bearing to the first structure; a plurality of limbs extending outwardly from the central connection point, wherein each limb includes a distal end, distal from the central connection point; and a plurality of distal connection points, located generally at each distal end of at least some of the plurality of limbs, for connecting the resilient bearing to the second structure, wherein the resilient bearing is formed from a single piece of elastic material adapted to dampen forces due to environmental events.

In another aspect the invention provides a resilient bearing, positioned between a first structure and a second structure, including: a central connection point for connecting the resilient bearing to the first structure; a plurality of limbs extending outwardly from the central connection point, wherein each limb includes a distal end, distal from the central connection point; and a plurality of distal connection points, located generally at each distal end of at least some of the plurality of limbs, for connecting the resilient bearing to the second structure, wherein the limbs are adapted to support the weight of either the first structure or second structure and wherein the angle between each of at least some of the plurality of limbs and the second structure is between 20 and 70 degrees.

In another aspect the invention provides a resilient bearing, positioned between a first structure and a second structure, including: a central connection point for connecting the resilient bearing to the first structure; a plurality of limbs extending outwardly from the central connection point, wherein each limb includes a distal end, distal from the central connection point; and a plurality of distal connection points, located generally at each distal end of at least some of the plurality of limbs, for connecting the resilient bearing to the second structure, wherein the resilient bearing is formed from an elastic material adapted to dampen forces due to environmental events and wherein a functional property of the elastic material varies along each of at least some of the plurality of limbs.

BRIEF DESCRIPTION OF THE DRAWINGS

The invention will now be described by way of example only, with reference to the accompanying drawings, in which:

FIG. 3 shows a cross-section of the resilient bearing of FIG. 1 through A-A;

DETAILED DESCRIPTION

The invention concerns a resilient bearing. The resilient bearing acts as a dampener against environmental events that may apply forces to structures. For the remainder of this specification, and without limiting the scope of the invention, the resilient bearing will be discussed in the context of dampening against seismic forces. Those skilled in the art will appreciate that the resilient bearing may also dampen against other types of environmental events, such as wind forces or localised vibrations, and the invention is not limited in this respect.

As will be discussed in more detail below, the resilient bearing is adapted to be positioned between a first structure and second structure. Depending on the relative positions, one of the structures may be considered a 'substructure', such as a foundation whilst the other structure may be considered a 'superstructure', such as a building, a non-building structure or piece of infrastructure. For the remainder of this specification the resilient bearing will be discussed in the context of a foundation and a building since this is one of the most common uses of bearings. Nevertheless, those skilled in the art will also appreciate how the resilient bearing may be adapted to be positioned between other types of structures, and the invention is not limited in this respect.

The resilient bearing of the present invention may be suitable for use with buildings such as residential houses and other similar-sized buildings. However, it will be appreciated how the resilient bearing may be adapted for use with buildings of other sizes size and constructions. Similarly, the resilient bearing may be suitable for use with a variety of foundations, including screw piles, footings and concrete pads, and the invention is not limited in this respect.

Figure 1:
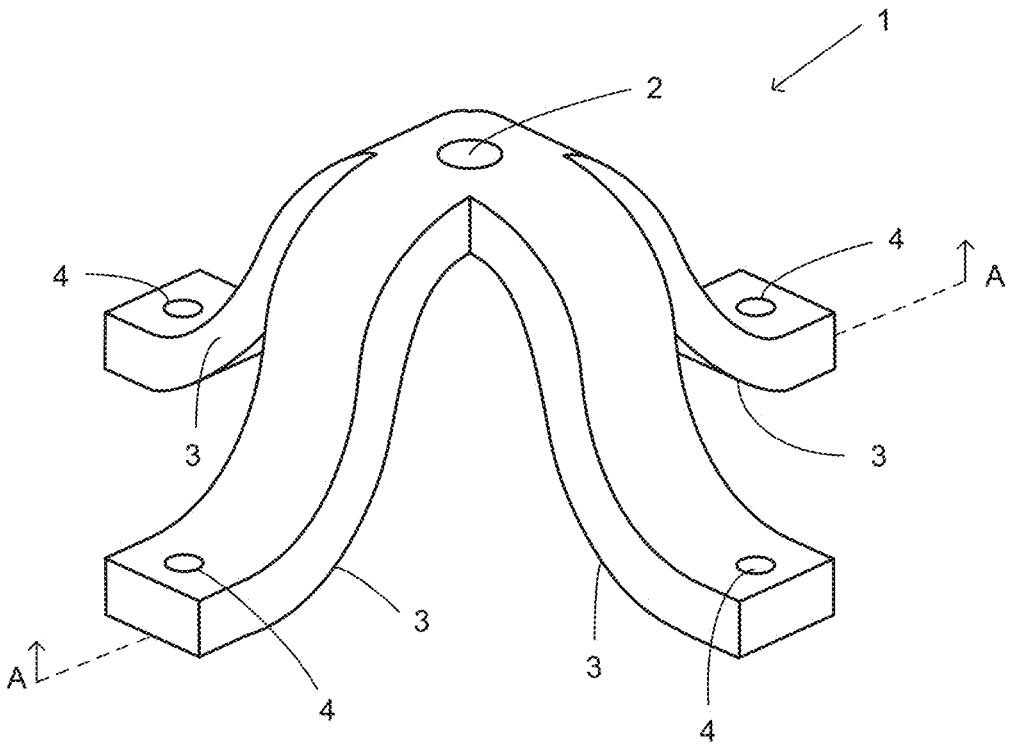
FIG. 1 shows a view of a resilient bearing according to one embodiment of the invention.

Referring to FIG. 1, there is shown a resilient bearing 1 according to one embodiment.

The resilient bearing 1 includes a central connection point 2, a plurality of limbs 3, and distal connection points 4 on the distal end of each limb. As described above, the resilient bearing is adapted to be positioned between a foundation and a building (not shown in FIG. 1).

In one embodiment, the resilient bearing is generally made of an elastic material. Those skilled in the art will appreciate that any number of elastic materials may be suitable, including, but not limited to vulcanised rubber. The elastomeric properties of the elastic material will be selected depending on the performance requirements and specific use of the resilient bearing. In one embodiment, the elastic material may be selected so that it performs substantially the same under compressive, tensile and shear deformation. The resilient bearing may be formed from a single piece of elastic material. If appropriate for the elastic material, the resilient bearing may be moulded from the elastic material using a range of suitable moulding techniques.

The central connection point 2 is positioned generally towards the centre of the resilient bearing. The central connection point is adapted to connect the resilient bearing to the building via a connection mechanism. In one embodiment, the connection mechanism is a bolt that passes through the structure and the central connection point. In another embodiment, there may be multiple bolts or other fasteners. The building may also need to be suitably adapted to connect to the resilient bearing via the central connection point. Those skilled in the art will appreciate that this will depend on the particular construction of the building and the particular connection mechanism employed and the invention is not limited in this respect. In one embodiment, the underfloor of the building may be adapted to include an element for connecting with the connection mechanism. If the building includes a concrete pad (or similar), these may be adapted with 'pockets' to receive the resilient bearing.

The resilient bearing 1 also includes a plurality of limbs 3. The limbs extend outwardly from the central connection point 2. At the end of each limb distal from the central connection point is a distal connection point 4. In some embodiments, some of the limbs may not have distal connection points. The distal connection point is adapted to connect the resilient bearing to the foundation (not shown) via a connection mechanism.

The limbs 3 are adapted to support the building whilst maintaining the integrity of the resilient bearing (i.e. allowing the limbs to compress under the weight of the building without the resilient bearing collapsing). Typically there will be multiple resilient bearings positioned strategically underneath a building, and therefore the limbs of each resilient bearing will need only support a portion of the entire weight of the building. Those skilled in the art will appreciate that to ensure the limbs have sufficient strength to bear the weight of the building (or portion thereof) at least the following interdependent variables will require consideration:

- the cross-sectional area of the limbs;
- the cross-sectional profile of the limbs;
- the geometry of the limbs; and
- the properties of the elastic material from which the limb is constructed.

Any suitable engineering technique may be used to determine which combination of variables is suitable for a resilient bearing for a particular use.

The limbs 3 are adapted to dampen applied horizontal, vertical and rotational forces. The limbs are adapted to form an angle with the foundation/building between 20 and 70 degrees. In some embodiments the angle may be between 30 and 60 degrees. In another embodiment, the angle may be between 40 and 50 degrees. It will be appreciated that the angle should be selected so as to satisfy the performance requirements in terms of vertical steady state support and horizontal, vertical and rotational dampening. Since the limb is not restricted to a straight limb, it will be appreciated by those skilled in the art that the angle may have to be suitably interpolated, as discussed below.

By having the limbs at an angle between 20 and 70 degrees the limbs provide dampening under horizontal, vertical and rotational forces. The limbs also restore the building to its normal position. Under horizontal forces (for example, a horizontal seismic force applied to the foundation), the limbs provide an opposing and dampening force due to the elasticity of the elastic material from which the limbs are made. In particular, the combination of compressive and shear or tensile and shear forces in the limbs will oppose and dampen the applied horizontal force. In this way, the resilient bearing is able to lessen the severity of the forces applied to the building.

Under vertical forces (for example, a vertical seismic force applied to the foundation), the limbs provide an opposing and dampening force due to the elasticity of the elastic material from which the limbs are made. In particular, the combination of compressive and shear forces (for vertical forces applied upwardly to the foundation) or tensile and shear forces (for vertical forces applied downwardly to the foundation) in the limb will oppose and dampen the applied vertical force. In this way, the resilient bearing is able to lessen the severity of the forces applied to the building.

Under rotational forces (for example, a rotational seismic force applied to the foundation), the limbs provide an opposing and dampening force due to the elasticity of the elastic material from which the limbs are made. In particular, the combination of tensile and shear forces in the limb will oppose and dampen the applied rotational force. In this way, the resilient bearing is able to lessen the severity of the forces applied to the building.

The distal connection points 4 are positioned generally towards the end of the limbs 3 distal from the central connection point 2. The distal connection points are adapted to connect the resilient bearing to the foundation via a connection mechanism. In one embodiment, the connection mechanism is a bolt or cam-lock that passes through the foundation and the distal connection point. In another embodiment, there may be multiple bolts or cam-locks at each distal connection point. The foundation may also need to be suitably adapted to connect to the resilient bearing via the distal connection point. Those skilled in the art will appreciate that this will depend on the particular construction of the foundation and the particular connection mechanism employed and the invention is not limited in this respect. In one embodiment, the foundation may be a generic screw pile adapted with a 'cap' to which the resilient bearing can be connected.

Figure 2:
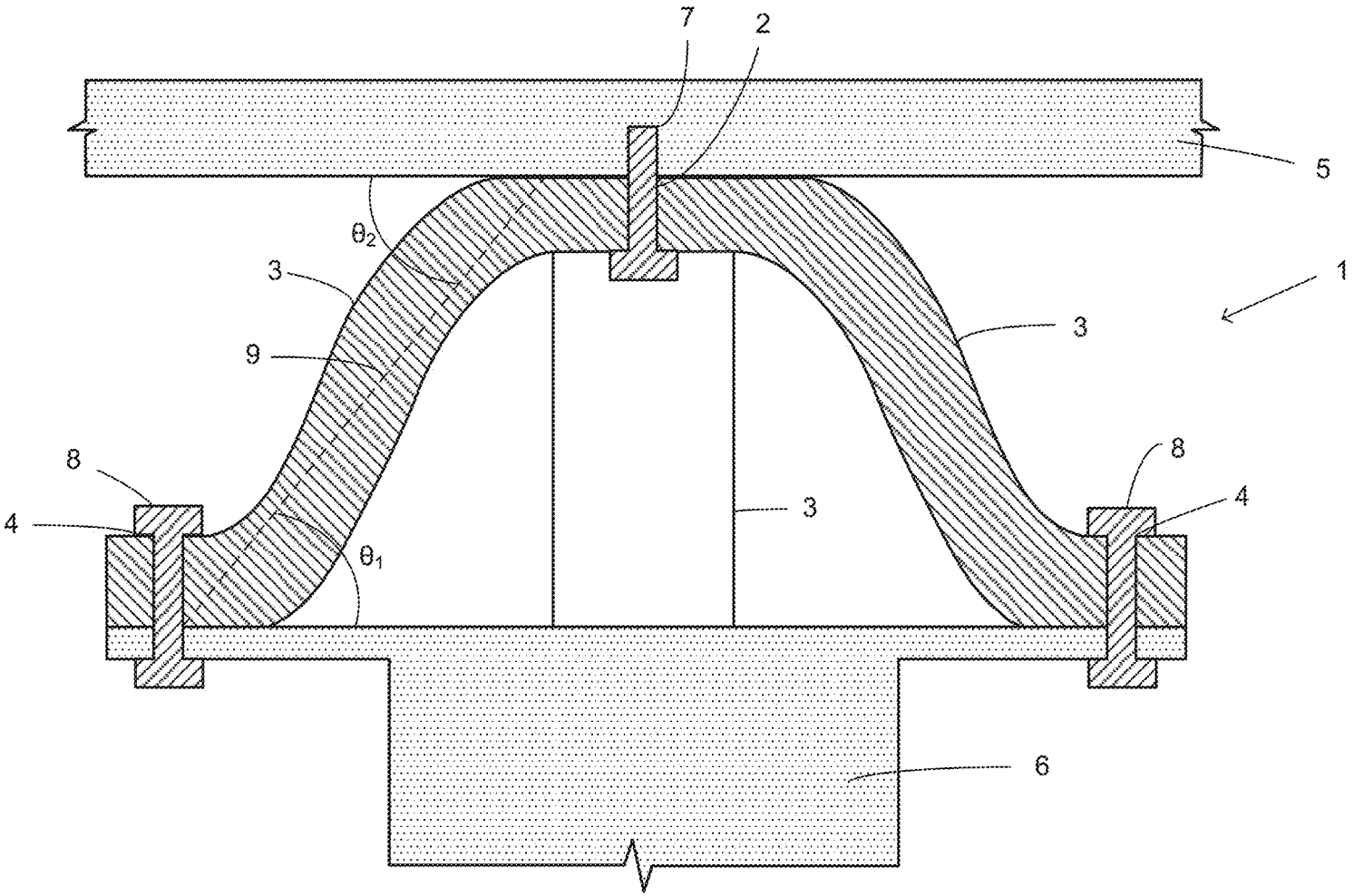
FIG. 2 shows a cross-section of the resilient bearing of FIG. 1 through A-A.

FIG. 2 shows a cross-section of a resilient bearing through line A-A of FIG. 1. The cross-section shows the resilient bearing 1 between a building 5 (represented by a horizontal element) and a foundation 6 (represented by another horizontal element). The cross-section also shows three of the four limbs 3. A bolt 7 (such as an expansion bolt) connects the central connection point 2 with the building. Further bolts 8 connect the distal connection points 4 with the foundation. As shown in the cross-section, in this embodiment the limbs are not straight but curved. Therefore, to determine the angle of the limbs to the foundation/building a line 9 may be interpolated through the limb with the angle, $\theta_1$, formed by this line and the plane of the foundation. Since the plane of the foundation and plane of the building are parallel, this angle will also be the same as the angle $\theta_2$, formed by this line 9 and the plane of the building.

Those skilled in the art will appreciate that to ensure the limbs have sufficient strength to meet the dampening requirements at least the following interdependent variables will require consideration:

- the cross-sectional area of the limbs;
- the cross-sectional profile of the limbs;
- the geometry of the limbs; and
- the properties of the elastic material from which the limb is constructed.

Any suitable engineering technique may be used to determine which combination of variables is suitable for a resilient bearing for a particular use.

The limbs may have a generally uniform cross-section. Any cross-section may be suitable depending on the performance requirements of the resilient bearing. In one embodiment, the limbs may have an isosceles trapezoidal cross-section. This has the benefit of increased strength on the underside of the limb and eases removal of the resilient bearing from a mould.

Similarly, it may also be suitable for the thickness of the limbs and other parts of the resilient bearing to vary depending on which parts of the resilient bearing need more strength. As shown in FIG. 2, the resilient bearing 1 has a generally constant thickness. However, this may be varied, for example by having thinner profile around the central connection point and the distal connection points where less strength is needed.

In another embodiment, it may be possible for a functional property of the elastic material to vary in the resilient bearing. In particular, the magnitude of the functional property may vary along the length of the limbs. Such a functional property may be elasticity or hardness or any other functional property that an elastic material may have. By way of example, it may be desirable to have increased hardness around the connection points or it may be desirable to have increased elasticity along the middle parts of the limbs. FIG. 3 shows a cross-section of a resilient bearing 1 through line A-A of FIG. 1. The sectional surface has been shaded to illustrate one possible variation in the magnitude of a functional property. For example, the darker, denser shading may be indicative of increased hardness or decreased elasticity. Similarly, the light, less dense shading may be indicative of decreased hardness or increased elasticity. In this embodiment, it will be appreciated that the variation in the functional property is continuous. This may be achieved by gradually adjusting the elastic material as it is added to the mould. In this embodiment, the functional property varies along the limbs 3. In another embodiment, the variation in the functional property may be discrete comprising individual sections with a various functional property.

Having elastic material with a variation in a functional property may be used instead of, or in conjunction with, varying the geometry of the parts of the resilient bearing so that the resilient bearing has the desired support and dampening characteristics. This may allow parts of the resilient bearing to be as small as possible, thus minimising the overall cost of the resilient bearing. Further, by customising the variation in a functional property, resilient bearings may be tailor-made for specific applications whilst maintaining the same geometry. This is particularly beneficial for moulded resilient bearings whereby a single mould can be used to produce a variety of resilient bearings simply by varying the distribution and properties of the elastic material.

Referring again to FIG. 1, the resilient bearing 1 has four limbs 3 spaced evenly around the central connection point.

Figure 4A:
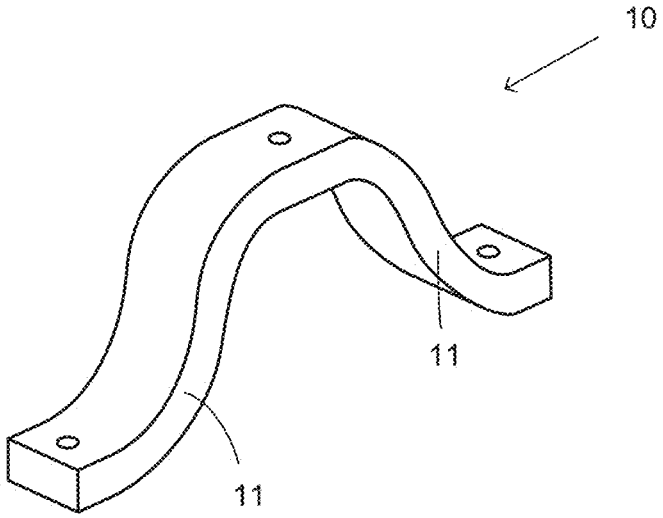
FIG. 4*a* shows a view of a resilient bearing according to one embodiment of the invention.
Figure 4B:
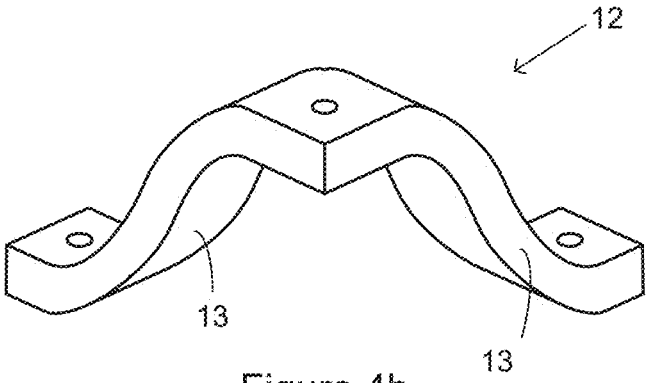
FIG. 4*b* shows a view of a resilient bearing according to one embodiment of the invention.
Figure 4C:
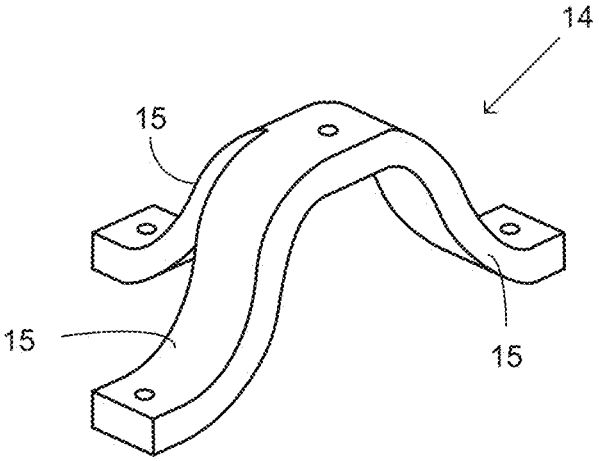
FIG. 4*c* shows a view of a resilient bearing according to one embodiment of the invention.

This is suitable as it provides dampening in any horizontal direction. However, it will be appreciated that there may be any number of limbs suitable for different types of connection. FIG. 4*a* shows a variation of the resilient bearing 10 with two limbs 11. Further, the spacing of the limbs does not have to been even. FIG. 4*b* shows a variation of the resilient bearing 12 with two limbs 13 generally perpendicular for each other. FIG. 4*c* shows a variation of the resilient bearing 14 with three limbs 15. Without limiting the possible configurations, other suitable arrangements of limbs may be three or six limbs spaced evenly about the central connection point. Though FIGS. 4*a* to 4*c* show identical limbs, in another possible embodiment, the size and shape of individual limbs may also differ. As will be discussed in more detail below, the number and spacing of the limbs may be dependent on the position of the resilient bearing under the building.

Figure 5:
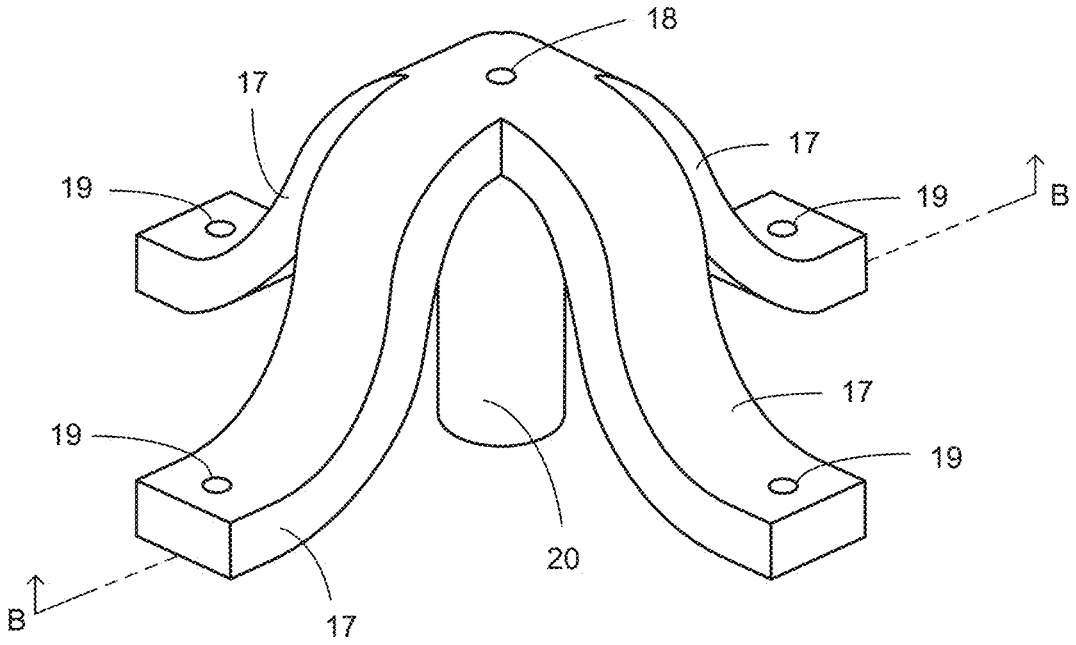
FIG. 5 shows a view of a resilient bearing according to one embodiment of the invention.

FIG. 5 shows another variation of a resilient bearing 16. The resilient bearing includes a plurality of limbs 17. The limbs extend outwardly from the central connection point 18. At the end of each limb distal from the central connection point is a distal connection point 19. Extending below the central connection point is a central supporting column 20 that acts as a vertical support. Such a vertical support acts in conjunction with the limbs to bear the weight of the building and also to provide dampening against vertical forces. The central supporting column may be formed with the rest of the resilient bearing, for example, via a moulding process. The central supporting column may have a uniform cross section, for example circular or rectangular. In a further embodiment, the central supporting column may consist of a series of shims, allowing the height of the column to be adjusted onsite.

Figure 6:
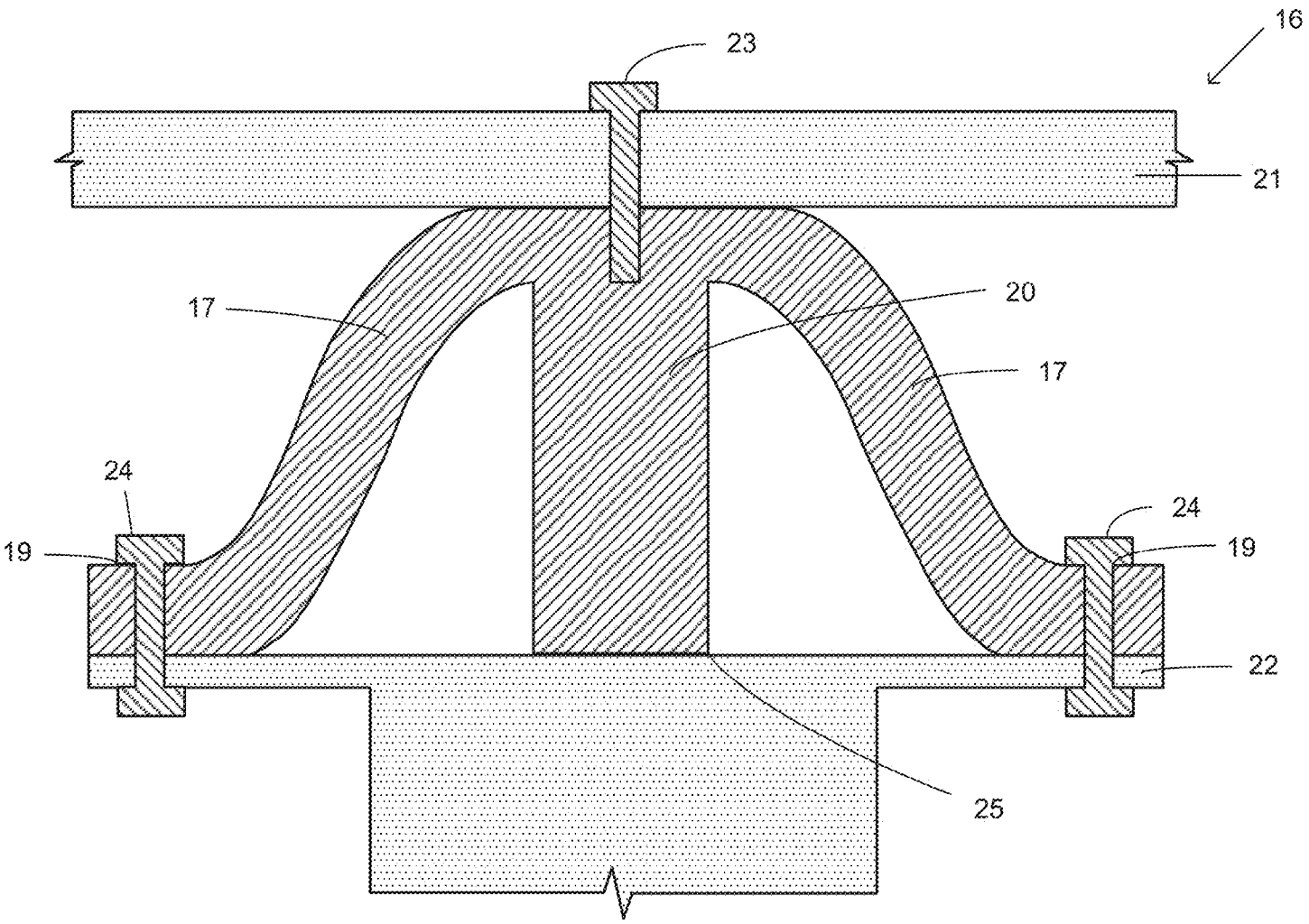
FIG. 6 shows a cross-section of the resilient bearing of FIG. 5 through B-B.

FIG. 6 shows a cross-section of a resilient bearing through line B-B of FIG. 2. The cross-section shows the resilient bearing 16 between a building 21 (represented by a horizontal element) and a foundation 22 (represented by another horizontal element). The cross-section also shows two of the four limbs 17 and the central supporting column 20. A bolt 23 connects the central connection point 18 with the building. Further bolts 24 connect the distal connection points 19 with the foundation. This view also shows that the end of the central supporting column distal from the central connection point 25 is adjacent to, but not connected to, the foundation. Thus, the central supporting column bears the weight of the building (in conjunction with the limbs) and also provides dampening against upwardly vertical forces applied upwardly to the foundation. However, for other applied forces, the central supporting column is able to move relative to the foundation. For example, under horizontal forces, the end of the central supporting column 25 slides over the foundation.

For all of the embodiments of the resilient discussed so far, the central connection point has connected to the building (i.e. the superstructure) and the distal connection points have connected to the foundation (i.e. the substructure). However, those skilled in the art will appreciate that the resilient bearing will perform the same with the orientation reversed.

Figure 7:
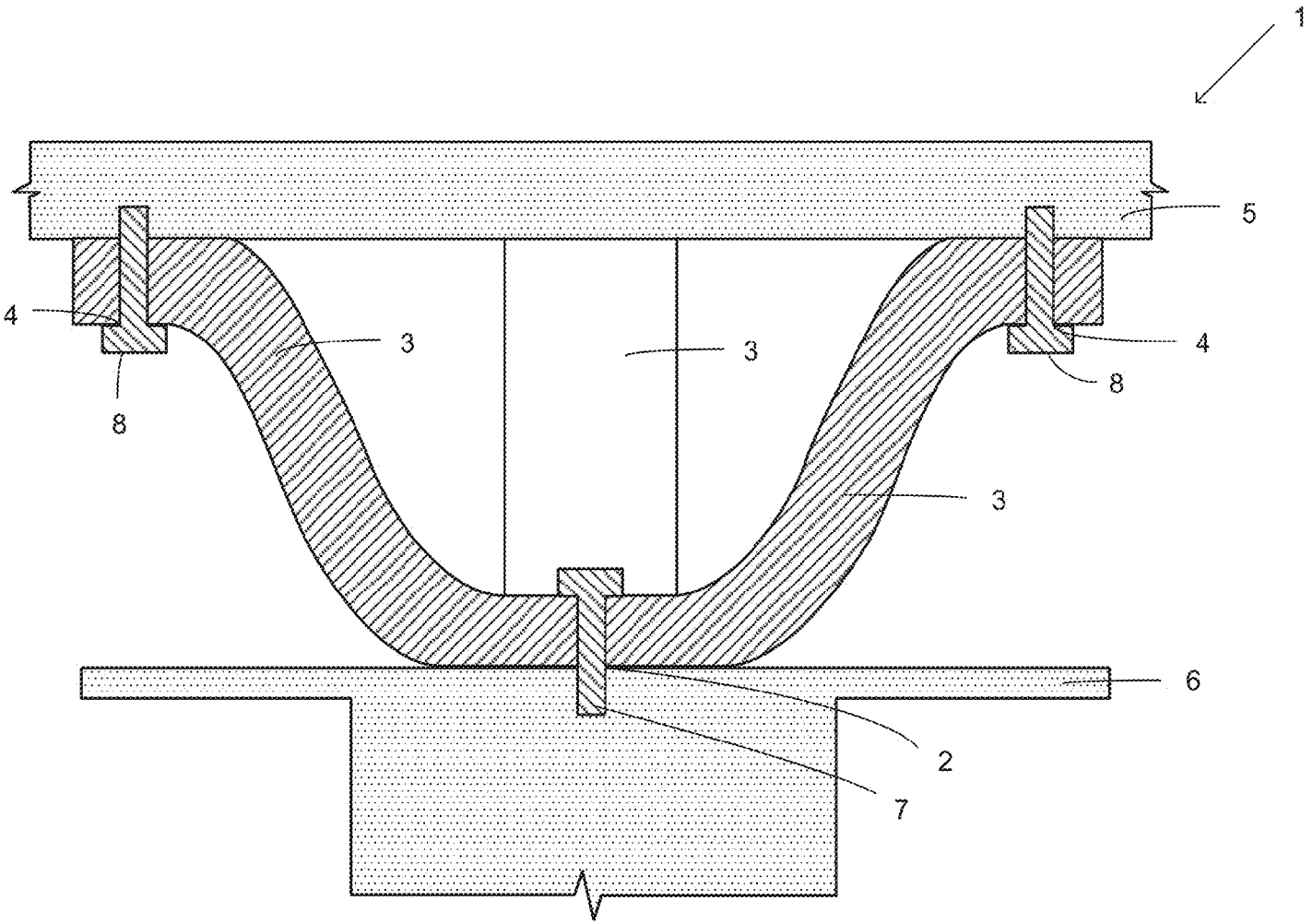
FIG. 7 shows a cross-section of s resilient bearing according to one embodiment of the invention.

FIG. 7 shows a cross-section of a variation of the embodiment of the resilient bearing discussed above in relation to FIG. 2. The cross-section shows the resilient bearing 1 between a building 5 (represented by a horizontal element) and a foundation 6 (represented by another horizontal element). The cross-section also shows three of the four limbs 3. A bolt 7 connects the central connection point 2 with the foundation. Further bolts 8 connect the distal connection points 4 with the building.

Having discussed the details of the resilient bearings construction, those skilled in the art will appreciate how it may act as a dampener. Due to its uniform construction, it is relatively inexpensive to manufacture. Similarly, as discussed in more detail below without a complex design it is easy to install.

Those skilled in the art will appreciate how installation of the resilient bearing described above is dependent upon the particular construction of the structure. In one embodiment, the foundation may be built first. The resilient bearings are then attached to the foundation according to the connection mechanism. Finally, the building is built atop and connected to the resilient bearing according to the connection mechanism.

For example, if the foundation is screw piles the following approach may be used:

1. Install screw piles to depth necessary to provide weight bearing support;
2. Adjust height of screw piles so that they provide an even height;
3. Attach caps to the top of the screw piles, where the caps are adapted for the particular screw piles and also adapted to connect to the resilient bearing;
4. Connect resilient bearings to caps in accordance with the connection mechanism—for example, bolts; and
5. Build building on top of resilient bearings, connecting the building to the resilient bearing using the connection mechanism.

In another possible embodiment, the resilient bearings of the present invention may be suitable for retro-fitting into existing structures, either by replacing other bearings or by adding the bearings. This may require separating and raising the building from its foundation, for example, by hydraulic jacks. The resilient bearings may then be inserted between the foundation and the building. This may require suitably adapting the foundation and/or building so that they can be connected to the resilient via the connection mechanism.

As mentioned above, it may be possible to install a variety of resilient bearings in a single building. The resilient bearings may vary with respect to any number of features including: the geometry of the resilient bearing; the number and spacing of limbs; or functional properties of the material of the resilient bearing. Any suitable engineering technique may be employed to determine what types of resilient bearings are needed and where they should be placed underneath a building. This will require consideration of the total support required by the building, as well as forecasting and ensuring the resilient bearings can support and dampen the variety of forces that the foundation and building will be subjected to.

Figure 8:
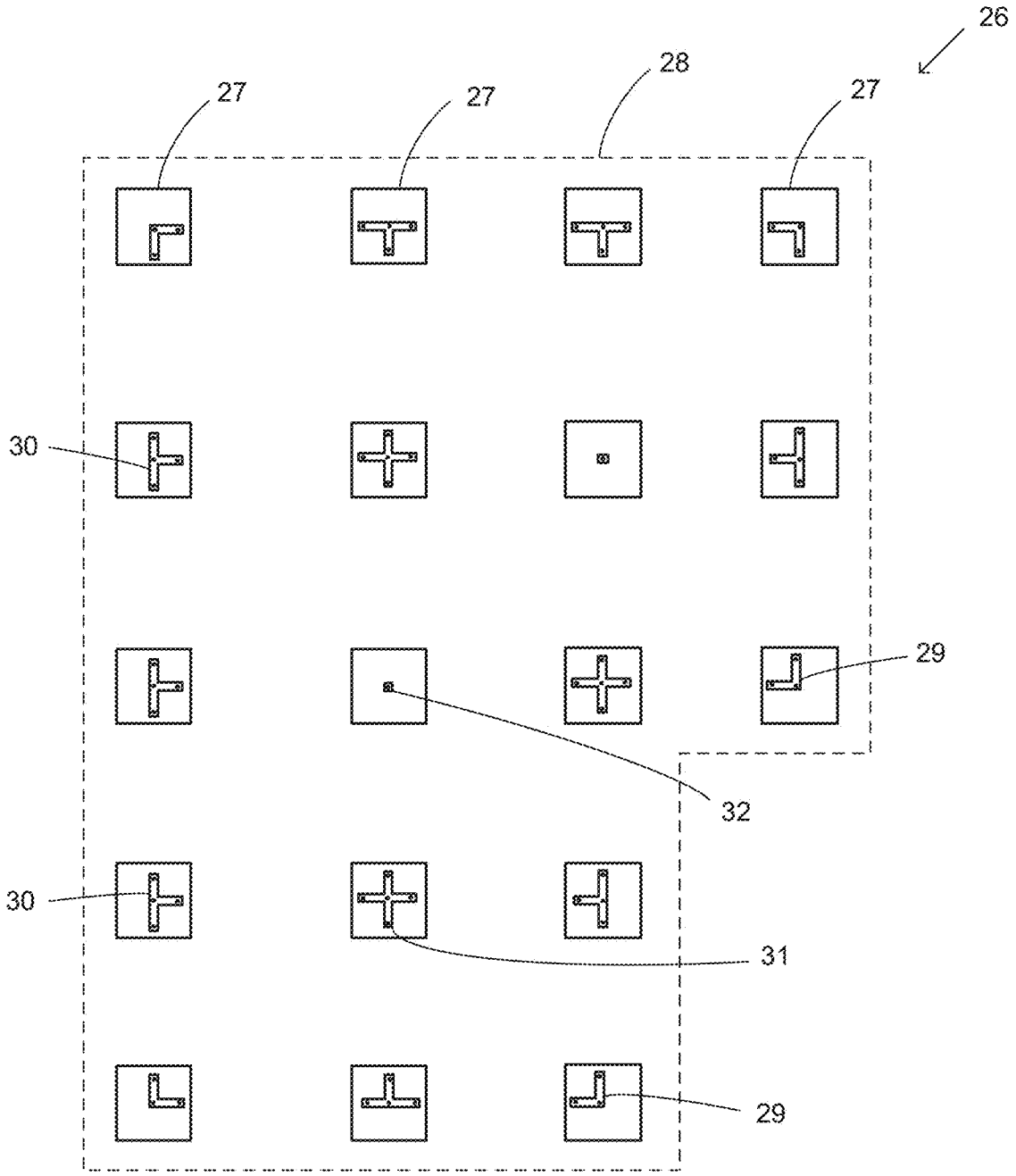
FIG. 8 shows a floor plan.

FIG. 8 shows a floor plan 26 representing an example installation of resilient bearings on top of screw piles 27. The general boundary of the building will correspond to the foundation and is shown by a dotted line 28. On the corners of the foundation are resilient bearings having two orthogonal limbs 29. On the edges of the foundation are resilient bearings having three limbs 30. In central positions there are provided resilient bearings with four limbs 31. If it is determined that the resilient bearings do not provide enough support on their own, then additional support columns without limbs 32 may be installed. Such support columns may be desirable where it is suitable to allow a certain degree of freedom of movement (for example, to allow a building a certain amount of 'twist').

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

What is claimed is:

1. A resilient bearing, positioned between a first structure and a second structure, including:

a. an elongate central support having a first end and a second end, the second end being adjacent to, but able to move relative to, the second structure;

b. a central connection point for connecting the resilient bearing to the first structure connected to the first end of the elongate central support;

c. a plurality of limbs extending outwardly from the central connection point, wherein each limb includes a distal end, distal from the central connection point; and d. a plurality of distal connection points, located generally at each distal end of each limb, for connecting the resilient bearing to the second structure, wherein the resilient bearing is formed from a single piece of elastic material adapted to dampen forces imposed on a building due to seismic activity.

2. The resilient bearing as claimed in claim 1, wherein the first structure is a building and the second structure is a foundation.

3. The resilient bearing as claimed in claim 1, wherein the first structure is a foundation and the second structure is a building.

4. The resilient bearing as claimed in claim 1, wherein the first structure is adapted to connect to the central connection point.

5. The resilient bearing as claimed in claim 1, wherein the second structure is adapted to connect to the plurality of distal connection points.

6. The resilient bearing as claimed in claim 1, wherein the plurality of limbs are adapted to support the weight of either the first structure or the second structure.

7. The resilient bearing as claimed in claim 1, wherein each limb has a trapezoidal cross-section.

8. The resilient bearing as claimed in claim 1, wherein the plurality of limbs are evenly distributed around the central connection point.

9. The resilient bearing as claimed in claim 1, wherein there are between two and four limbs.

10. The resilient bearing as claimed in claim 1, wherein the angle between each of at least some of the plurality of limbs and the second structure is between 20 and 70 degrees.

11. The resilient bearing as claimed in claim 1, wherein the angle between each of at least some of the plurality of limbs and the second structure is between 30 and 60 degrees.

12. The resilient bearing as claimed in claim 1, wherein the angle between each of at least some of the plurality of limbs and the second structure is between 40 and 50 degrees.

13. The resilient bearing as claimed in claim 1, wherein the vertical support is a supporting column, which supports the weight of either the first structure or the second structure.

14. The resilient bearing as claimed in claim 1, wherein the vertical support is formed in the single piece of elastic material.

15. The resilient bearing as claimed in claim 1, wherein the elastic material is a rubber.

16. A resilient bearing, positioned between a first structure and a second structure, including:

a. an elongate central support having a first end and a second end, the second end being adjacent to, but able to move relative to, the second structure;

b. a central connection point for connecting the resilient bearing to the first structure connected to the first end of the elongate central support;

c. a plurality of limbs extending outwardly from the central connection point, wherein each limb includes a distal end, distal from the central connection point; and d. a plurality of distal connection points, located generally at each distal end of each limb, for connecting the resilient bearing to the second structure, wherein the limbs are adapted to support the weight of a building and dampen seismic forces imposed on the building and wherein the angle between each of at least some of the plurality of limbs and the second structure is between 20 and 70 degrees.

17. The resilient bearing as claimed in claim 16, wherein the vertical support is a supporting column, which provides additional support for the weight of either the first structure or the second structure.

18. A resilient bearing, positioned between a first structure and a second structure, including:

a. an elongate central support having a first end and a second end, the second end being adjacent to, but able to move relative to, the second structure;

b. a central connection point for connecting the resilient bearing to the first structure connected to the first end of the elongate central support;

c. a plurality of limbs extending outwardly from the central connection point, wherein each limb includes a distal end, distal from the central connection point; and d. a plurality of distal connection points, located generally at each distal end of each limb, for connecting the resilient bearing to the second structure, wherein the resilient bearing is formed from an elastic material adapted to dampen forces due to seismic forces imposed on a building supported by the resilient bearing and wherein a functional property of the elastic material varies along each of at least some of the plurality of limbs.

19. The resilient bearing as claimed in claim 18, wherein the functional property is the hardness of the elastic material.

20. The resilient bearing as claim in claim 19, wherein the hardness of the elastic material in the plurality of limbs is higher at the distal connection points and the central connection point and lower between the distal connection points and the central connection point.

21. The resilient bearing as claimed in claim 18, wherein the functional property is the elasticity of the elastic material.

22. The resilient bearing as claim in claim 21, wherein the elasticity of the elastic material in the plurality of limbs is lower at the distal connection points and the central connection point and higher between the distal connection points and the central connection point.

* * * * *